US011552381B2

(12) United States Patent
Hsu et al.

(10) Patent No.: US 11,552,381 B2
(45) Date of Patent: Jan. 10, 2023

(54) ELECTRONIC DEVICE

(71) Applicant: Getac Technology Corporation, Hsinchu County (TW)

(72) Inventors: Wan-Lin Hsu, Taipei (TW); Juei-Chi Chang, Taipei (TW); Ping-Chung Chen, Taipei (TW); Jia-Min Huang, Taipei (TW)

(73) Assignee: GETAC TECHNOLOGY CORPORATION, Hsinchu County (TW)

( * ) Notice: Subject to any disclaimer, the term of this patent is extended or adjusted under 35 U.S.C. 154(b) by 33 days.

(21) Appl. No.: 17/182,513

(22) Filed: Feb. 23, 2021

(65) Prior Publication Data

US 2022/0271413 A1 Aug. 25, 2022

(51) Int. Cl.

| | |
|---|---|
| ***H01Q 1/22*** | (2006.01) |
| ***H01Q 9/04*** | (2006.01) |
| ***H01Q 21/08*** | (2006.01) |
| ***H01Q 5/307*** | (2015.01) |

(52) U.S. Cl.

CPC ..... *H01Q 1/2266* (2013.01); *H01Q 5/307* (2015.01); *H01Q 9/0407* (2013.01); *H01Q 21/08* (2013.01)

(58) Field of Classification Search

CPC ..... H01Q 1/2266; H01Q 1/243; H01Q 5/307; H01Q 1/241; H01Q 1/242; H01Q 5/20; H01Q 5/30; H01Q 9/0407; H01Q 21/08; H01Q 21/28; H01Q 21/20; G06F 1/1601; G06F 1/1616; G06F 1/1656; H04M 1/02; H04M 1/026; H04M 1/0214; H04M 1/0216; H04B 1/0064

USPC ..... 361/679

See application file for complete search history.

(56) References Cited

U.S. PATENT DOCUMENTS

| | | | | |
|---|---|---|---|---|
| 11,026,071 | B1 * | 6/2021 | Files | H04W 4/40 |
| 2008/0316115 | A1 * | 12/2008 | Hill | H01Q 21/30 343/702 |
| 2010/0090909 | A1 * | 4/2010 | Ella | H01Q 9/40 343/702 |
| 2016/0204499 | A1 * | 7/2016 | Toh | H01Q 21/28 343/702 |
| 2019/0098553 | A1 * | 3/2019 | Koshy | H04W 40/06 |
| 2020/0341520 | A1 * | 10/2020 | Chen | G06F 1/1637 |
| 2020/0411957 | A1 * | 12/2020 | Zhu | H01Q 9/42 |

(Continued)

FOREIGN PATENT DOCUMENTS

| | | | | |
|---|---|---|---|---|
| CN | 101278438 B | * | 2/2013 | G08B 7/066 |

*Primary Examiner* — Dameon E Levi
*Assistant Examiner* — Leah Rosenberg
(74) *Attorney, Agent, or Firm* — Locke Lord LLP; Tim Tingkang Xia, Esq.

(57) ABSTRACT

The present invention discloses an antenna module and an electronic device. The antenna module is used in the electronic device. The electronic device includes a first housing. The antenna module includes a first antenna, a second antenna and a third antenna. The first antenna is disposed in the first housing and operates at a first frequency band. The second antenna is disposed in the first housing and operates at a second frequency band. The third antenna is disposed in the first housing and is located between the first antenna and the second antenna, and operates at a third frequency band. The first frequency band partially overlaps with the second frequency band, and the third frequency band does not overlap with the first frequency band and the second frequency band.

17 Claims, 5 Drawing Sheets

(56) References Cited

U.S. PATENT DOCUMENTS

| | | | | |
|---|---|---|---|---|
| 2020/0412015 | A1* | 12/2020 | Zhang | H01Q 13/08 |
| 2021/0028540 | A1* | 1/2021 | Rom | H01Q 3/24 |
| 2021/0119331 | A1* | 4/2021 | Niakan | H01Q 1/523 |
| 2021/0126349 | A1* | 4/2021 | Zhou | H01Q 1/243 |
| 2021/0167487 | A1* | 6/2021 | Varma | H01Q 25/005 |
| 2021/0328329 | A1* | 10/2021 | Kim | H01Q 1/243 |

* cited by examiner

ELECTRONIC DEVICE

FIELD OF THE INVENTION

The present invention relates to an antenna module and an electronic device, and more particularly to an antenna module integrated with a plurality of antennas and an electronic device.

DESCRIPTION OF THE PRIOR ART

Various wireless communication technologies have emerged along with the development of wireless communication technologies, for example, Wi-Fi or wireless local area network (WLAN), Bluetooth, Global Positioning System (GPS), Fourth-Generation Long-Term Evolution (LTE), and Fifth-Generation Mobile Communication System (5G system). Current electronic device manufactures are inclined to integrating the wireless communication technologies above into one single electronic device (for example, laptop computers, tablet computers and smartphones), so as to meet diversified user application requirements. However, hardware modules used by the wireless communication technologies above are different, and thus different matching antennas are needed to implement the wireless communication technologies above.

In a situation where different antennas are configured, there is a concern of mutual interference of signals among the antennas. Thus, when multiple antennas are integrated in one single electronic device, how to optimize the overall wireless communication performance of the electronic device according to characteristics of different antennas and mutual influences (for example, degree of isolation, radiation field pattern, gain value, and anti-noise capability) among different antennas has become one critical task that needs to be resolved in the related industry.

Moreover, safety specifications (for example, specific absorption rate (SAR) test specifications) have been formulated globally in various countries with respect to the safety of wireless communication products, in order to ensure that radio-frequency energy emitted by wireless communication products is insufficient to cause harm of human tissues. Therefore, how to allow an electronic device to meet safety specifications of wireless communication products under the premise that the overall communication performance of the electronic device is unaffected also stands as one critical task that needs to be resolved in the related industry.

SUMMARY OF THE INVENTION

The technical problem to be solved by the present invention is how to provide an antenna module and an electronic device with respect to the drawbacks of the prior art.

To solve the foregoing technical problems, an electronic device is provided according to a technical solution of the present invention. The electronic device includes a first housing and an antenna module. The antenna module includes a first antenna, a second antenna and a third antenna. The first antenna is disposed in the first housing and operates at a first frequency band. The second antenna is disposed in the first housing and operates at a second frequency band. The third antenna is disposed in the first housing and is located between the first antenna and the second antenna, and operates at a third frequency band. The first frequency band partially overlaps with the second frequency band, and the third frequency band does not overlap with the first frequency band and the second frequency band.

One benefit of the present invention is that, the antenna module and the electronic device provided by the present invention are, by the technical solution of "configuring the positions of the plurality of antennas in the antenna module or in the first housing and configuring the position of the other antenna in the second housing according to antenna characteristics (for example, operating frequency range, radiation field pattern and polarization direction) of the plurality of antennas, capable of optimizing the overall wireless communication performance of the electronic device to meet application requirements and allowing the electronic device to meet safety specifications of wireless communication products.

One benefit of the present invention is that, the antenna module and the electronic device provided by the present invention are, by the technical solution of "configuring the field pattern orientation of three antennas to be non-overlapping, and enabling the radiation field patterns of the three antennas to be complementary and hence equivalent to a 360-degree omnidirectional antenna", capable of optimizing the overall wireless communication performance of the electronic device to meet application requirements.

Details of the description and drawings of the present invention are given below to better understand the features and technical contents of the present invention. It should be noted that the drawings provided are merely for reference and illustration, and are not to be construed as limitations to the present invention.

DETAILED DESCRIPTION OF THE EMBODIMENTS

Implementation details related to "an antenna module and an electronic device" disclosed by the present invention are described in the specific embodiments below, and a person skilled in the art could understand the advantages and effects of the present invention on the basis of the contents disclosed by the present application. The present invention can also be implemented or applied by other different specific embodiments, and various modifications and changes can also be made on the basis of different perspectives and applications without departing from the concept of the present invention. In addition, the accompanying drawings of the present invention are simple schematic illustrations and are not drawn according to actual sizes. The technical contents related to the present invention are further described in detail in the embodiments below; however, it should be noted that the disclosed contents are not to be construed as limitations to the scope of protection of the present invention. Further, the term "or" used in the literature may include any one or more combinations in related items listed, depending on actual conditions.

First Embodiment

Figure 1:
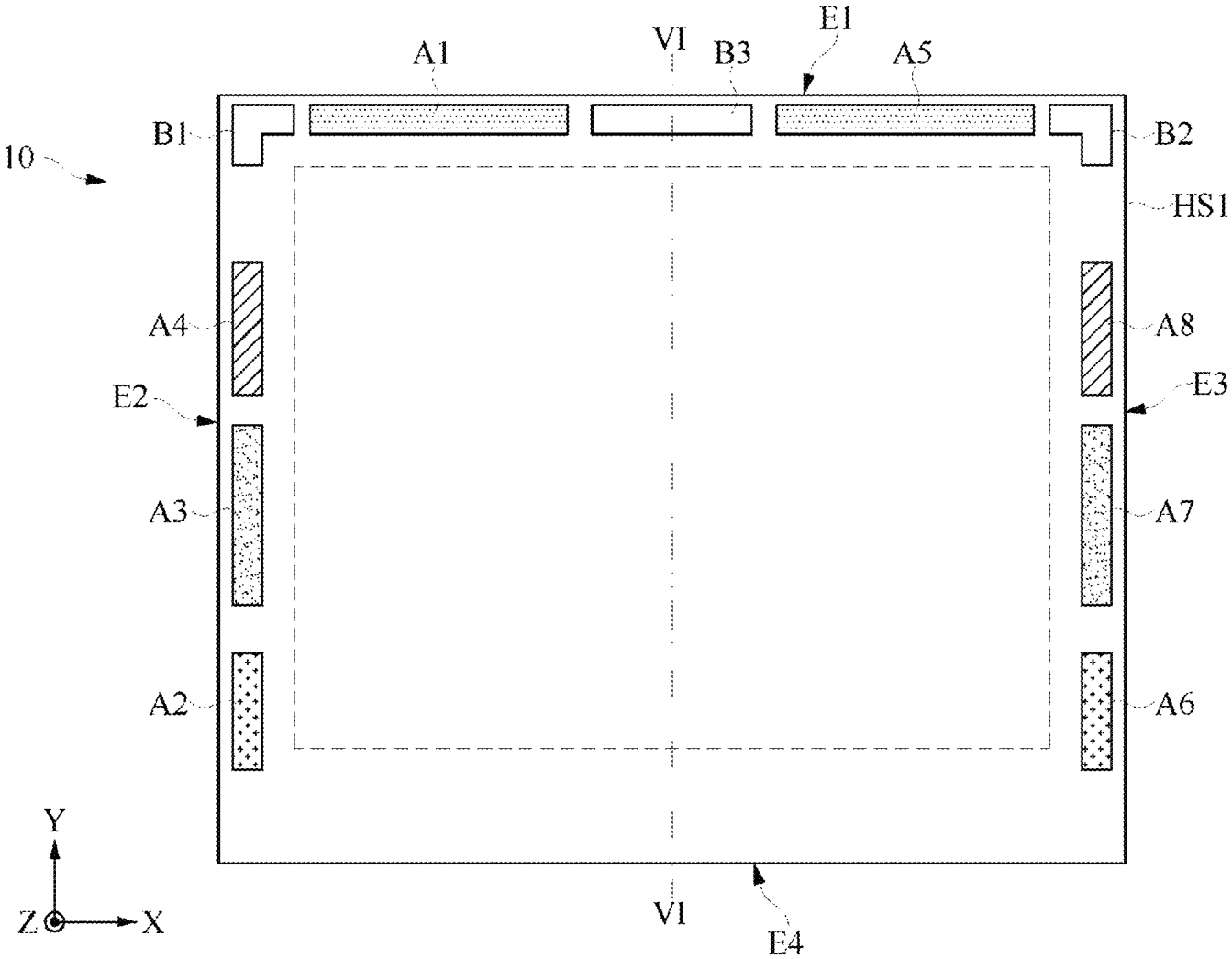
FIG. 1 is a front schematic diagram of an antenna module according to a first embodiment of the present invention.

FIG. 1 shows a front schematic diagram of a first antenna module 10 according to a first embodiment of the present invention. The antenna module 10 can be used in an electronic device 2 (shown in FIG. 2), wherein the electronic device 2 includes a first hosing HS1. The antenna module 10 includes a first antenna A1, a second antenna A2 and a third antenna A3. The first antenna A1 is disposed in the first housing HS1 and operates at a first frequency band. The second antenna A2 is disposed in the first housing HS1 and operates at a second frequency band. The third antenna A3 is disposed in the first housing HS1 and is located between the first antenna A1 and the second antenna A2, and operates at a third frequency band. The first frequency band partially overlaps with the second frequency band, and the third frequency band does not overlap with the first frequency band and the second frequency band. Because the first frequency band at which the first antenna operates partially overlaps with the second operating frequency at which the second antenna A2 operates, the present invention optimizes the degree of isolation between the first antenna A1 and the second antenna A2 by disposing the third antenna A3 between the first antenna A1 and the second antenna A2. More specifically, since the third frequency band at which the third antenna A3 operates does not overlap with the first frequency band and the second frequency band, even if the third antenna A3 is disposed near the first antenna A1 and the second antenna A2, the operation performance of the third antenna A3 is not affected.

The first housing HS1 includes a first edge E1, a second edge E2, a third edge E3 and a fourth edge E4. The first edge E1 is parallel to the fourth edge E4 and a direction X, and the second edge E2 is parallel to the third edge E3 and a direction Y. The first antenna A1 is disposed near the first edge E1, and the second antenna A2 and the third antenna A3 are disposed near the second edge E2. The first housing HS1 is parallel to a plane (for example, an X-Y plane) formed by the direction X and the direction Y, wherein the direction X, the direction Y and a direction Z are perpendicular to one another. Because the first frequency band at which the first antenna A1 operates partially overlaps with the second frequency band at which the second antenna A2 operates, given that polarization directions of the two (for example, the polarization direction parallel to the direction of a maximum dimension of an antenna body) are the same, the present invention disposes the first antenna A1 and the second antenna A2 on the first edge E1 and the second edge E2 that are perpendicular to each other, respectively, in a way that the polarization directions of the first antenna A1 and the second antenna A2 in space are perpendicular to each other (for example, the first antenna A1 is horizontally polarized, and the second antenna A2 is vertically polarized), so as to optimize the degree of isolation between the first antenna A1 and the second antenna A2. In one embodiment, the first antenna A1 and the second antenna A2 can also be provided with an enhanced degree of isolation by means of a junction between the first edge E1 and the second edge E2.

The antenna module 10 further includes a fourth antenna A4. The fourth antenna A4 is disposed near the second edge E2 and is located between the first antenna A1 and the third antenna A3, and operates at the first frequency. Because the first antenna A1 and the fourth antenna A4 operate at the same first frequency, given that the polarization directions of the two are also the same, the present invention disposes the first antenna A1 and the fourth antenna A4 on the first edge E1 and the second edge E2 that are perpendicular to each other, respectively, in a way that the polarization directions of the first antenna A1 and the fourth antenna A4 in space are perpendicular to each other (for example, the first antenna A1 is horizontally polarized and the fourth antenna A4 is vertically polarized), so as to optimize the degree of isolation between the first antenna A1 and the fourth antenna A4.

The antenna module 10 further includes a first blocking member B1, which is disposed near the junction of the first edge E1 and the second edge E2 and is located between the first antenna A1 and the fourth antenna A4. In one embodiment, the first blocking member B1 is made of a metal material and is L-shaped. In one embodiment, the material of the first blocking member B1 can also be non-metal, or can be a material or a structure that prohibits mutual interference of signals among the antennas. Because both the first antenna A1 and the fourth antenna A4 operate at the same first frequency band, the first blocking member B1 can serve as a reflector plate for reflecting radio frequency signals radiated from the first antenna A1 and the fourth antenna A4 (which is equivalent to adjusting the radiation field patterns of the first antenna A1 and the fourth antenna A4), so as to optimize the degree of isolation between the first antenna A1 and the fourth antenna A4.

The antenna module 10 further includes a fifth antenna A5, a sixth antenna A6, a seventh antenna A7 and an eighth antenna A8. The fifth antenna A5 is disposed near the first edge E1 and operates at the first frequency. The first antenna A1 is near the second edge E2, and the fifth antenna A5 is near the third edge E3. The sixth antenna A6 is disposed near the third edge E3 and operates at the second frequency band. The seventh antenna A7 is disposed near the third edge E3 and is located between the fifth antenna A5 and the sixth antenna A6, and operates at the third frequency band. The eighth antenna A8 is disposed near the third edge E3 and is located between the fifth antenna A5 and the seventh antenna A7, and operates at the first frequency band.

In one embodiment, the first antenna A1 and the fifth antenna A5 can be the same type of antennas. In one embodiment, the first antenna A1 and the fifth antenna A5 are a main antenna and an auxiliary antenna, respectively. In one embodiment, the second antenna A2 and the sixth antenna A6 can be the same type of antennas. In one embodiment, the second antenna A2 and the sixth antenna A6 are a main antenna and an auxiliary antenna, respectively. In one embodiment, the third antenna A3 and the seventh antenna A7 can be the same type of antennas. In one embodiment, the third antenna A3 and the seventh antenna A7 are a main antenna and an auxiliary antenna, respectively. In one embodiment, the fourth antenna A4 and the eighth antenna A8 can be the same type of antennas. In one embodiment, the fourth antenna A4 and the eighth antenna A8 are a main antenna and an auxiliary antenna, respectively. In one embodiment, the first antenna A1, the fourth antenna A4, the fifth antenna A5 and the eighth antenna A8 can be the same type of antennas. In one embodiment, the first antenna A1, the fourth antenna A4, the fifth antenna A5 and the eighth antenna A8 are a main antenna and three auxiliary antennas, respectively.

The first antenna A1 and the fifth antenna A5, the second antenna A2 and the sixth antenna A6, the third antenna A3 and the seventh antenna A7, and the fourth antenna A4 and the eighth antenna A8 are arranged symmetrically with respect to a center line VI-VI of the first housing HS1. In one embodiment, the first antenna A1 and the fifth antenna A5, the second antenna A2 and the sixth antenna A6, the third antenna A3 and the seventh antenna A7, and the fourth antenna A4 and the eighth antenna A8 are arranged on positions completely symmetrical with respect to the center line VI-VI of the first housing HS1. In one embodiment, the first antenna A1 and the fifth antenna A5, the second antenna A2 and the sixth antenna A6, the third antenna A3 and the seventh antenna A7, and the fourth antenna A4 and the eighth antenna A8 are arranged on positions symmetrical with respect to the center line VI-VI of the first housing HS1, but can also be slightly adjusted on the basis of configuration considerations.

In one embodiment, the range of the first frequency band is the first frequency range 1 (FR1) specified by the 5G system, and is within a frequency range of 450 MHz to 6 GHz; the range of the second frequency band is a frequency range of 2.4 GHz to 2.5 GHz or 5.15 GHz to 5.85 GHz specified by the Wi-Fi or WLAN communication system; the range of the third frequency band is the second frequency range 2 (FR2) specified by the 5G system, and is within a frequency range of 24 GHz to 52 GHz. Table-1 below shows operating frequency bands commonly used in wireless communication technologies. It is known from Table-1 that, the operating frequency bands used by wireless communication technologies may be completely overlapping, partially overlapping, and non-overlapping.

TABLE 1

| Wireless communication technology | Operating frequency band |
|---|---|
| Wi-Fi or WLAN | 2.4 GHz to 2.5 GHz ` 5.15 GHz to 5.85 GHz |
| Bluetooth | 2.4 GHz to 2.5 GHz |
| GPS | 1575.42 MHz, 1227.60 MHz |
| 4G system | 450 MHz to 3.7 GHz |
| 5G system | 450 MHz to 6 GHz, 24 GHz to 52 GHz |

Thus, the first antenna A1, the fourth antenna A4, the fifth antenna A5 and the eighth antenna A8 can support the FR1 of the 5G system; the second antenna A2 and the sixth antenna A6 can support the Wi-Fi or WLAN communication system; the third antenna A3 and the seventh antenna A7 can support the FR2 of the 5G system. Since the frequency range of the first frequency band is wider and lower, the first antenna A1, the fourth antenna A4, the fifth antenna A5 and the eighth antenna A8 are more likely to be interfered by noise (for example, electromagnetic radiation signals emitted from internal electronic components of the electronic device 2 in FIG. 2 may cause poor signal qualities of the antennas A1, A4, A5 and A8) compared to other antennas. Therefore, the present invention disposes the first antenna A1 and the fifth antenna A5 near the first edge E1, and disposes the fourth antenna A4 and the eighth antenna A8 near the junction between the first edge E1 and the second edge E2, so as to reduce the probability of noise interference upon the antennas A1, A4, A5 and A8.

Moreover, safety specifications (for example, specific absorption rate (SAR) test specifications) have been formulated globally in various countries with respect to the safety of wireless communication products, in order to ensure that radio-frequency energy emitted by wireless communication products is insufficient to cause harm of human tissues. Compared to high-frequency radio frequency signals, low-frequency radio frequency signals have a slower radio frequency energy attenuation rate when propagated in a medium. Hence, the present invention disposes the first antenna A1 and the fifth antenna A5 near the first edge E1, and disposes the fourth antenna A4 and the eighth antenna A8 near the junction of the first edge E1 and the second edge E2. Under such antenna placement, when a user operates the electronic device 2 in FIG. 2, the antennas A1, A4, A5 and A8 are kept away from human tissues (for example, the torso and thighs) as much as possible, so as to meet safety specifications of wireless communication products.

The antenna module 10 further includes a second blocking member B2. The second blocking member B2 is disposed between the fifth antenna A5 and the eighth antenna A8, and is disposed near the junction between the first edge E1 and the third edge E3. In one embodiment, the second blocking member B2 is made of a metal material and is L-shaped. In one embodiment, the second blocking member B2 can be of a material or structure the same as or similar to that of the first blocking member B1. Because the fifth antenna A5 and the eighth antenna A8 both operate at the first frequency band, the second blocking member B2 can serve as a reflector plate for reflecting radio frequency signals radiated from the fifth antenna A5 and the eighth antenna A8 (which is equivalent to adjusting the radiation field patterns of the fifth antenna A5 and the eighth antenna A8), so as to optimize the degree of isolation between the fifth antenna A5 and the eighth antenna A8.

The antenna module 10 further includes a third blocking member B3, which is disposed near the first edge E1 and is located between the first antenna A1 and the fifth antenna A5. In one embodiment, the third blocking member B3 can be made of a metal material and is L-shaped. In one embodiment, the third blocking member B3 can be of a material or structure the same as or similar to that of the first blocking member B1 or the second blocking member B2. Because the first antenna A1 and the fifth antenna A5 both operate at the first frequency band, the third blocking member B3 can serve as a reflector plate for reflecting radio frequency signals radiated from the first antenna A1 and the fifth antenna A5 (which is equivalent to adjusting the radiation field patterns of the first antenna A1 and the fifth antenna A5), so as to optimize the degree of isolation between the first antenna A1 and the fifth antenna A5.

Figure 2:
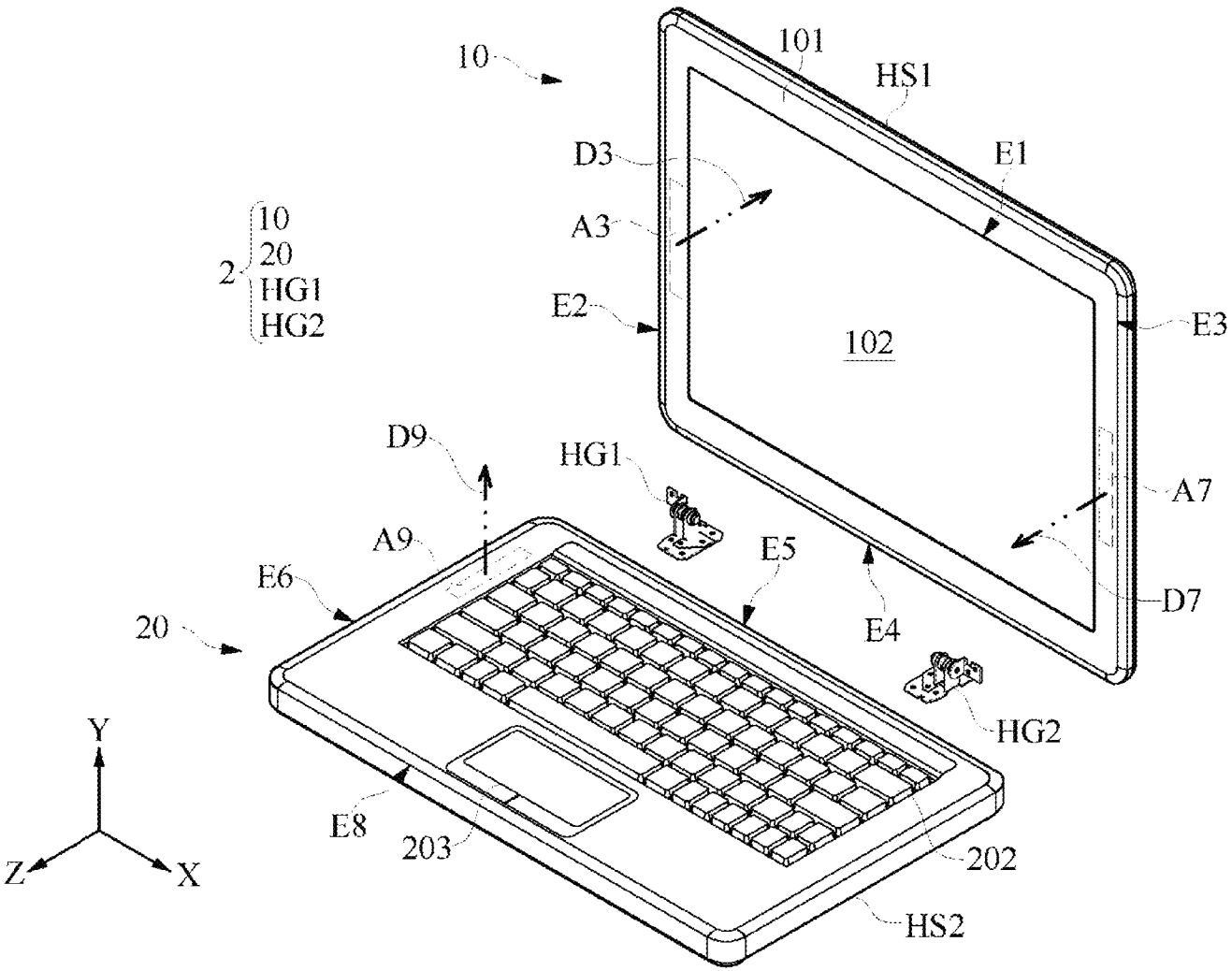
FIG. 2 is an exploded three-dimensional schematic diagram of an electronic device according to the first embodiment of the present invention.

FIG. 2 shows an exploded three-dimensional schematic diagram of an electronic device 2 according to the first embodiment of the present invention. The electronic device 2 further includes a second housing HS2 and a system module 20 disposed in the second housing HS2. The second housing HS2 has a fifth edge E5, a sixth edge E6, a seventh edge E7 and an eighth edge E8. The fifth edge E5 is parallel to the eighth edge E8, the sixth edge E6 is parallel to the seventh edge E7, the fifth edge E5 of the second housing HS2 is pivotally connected to the fourth edge E4 of the first housing HS1, and the sixth edge E6 and the seventh edge E7 respectively correspond to the second edge E2 and the third edge E3 of the first housing HS1. In other words, the second edge E2 and the sixth edge E6 are located on the same side with respect to the center line VI-VI, and the third edge E3 and the seventh edge E7 are located on the second side with respect to the center line VI-VI. Alternatively speaking, when the first housing HS1 and the second housing HS2 are closed, the second edge E2 is in contact with the sixth edge E6; when the first housing HS1 and the second housing HS2 are closed, the third edge E3 is in contact with the seventh edge E7. In one embodiment, the electronic device 2 includes a first pivot hinge HG1 and a second pivot hinge HG2 for pivotally connecting, for example but not limited to, the first housing HS1 and the second housing HS2. In one embodiment, the first housing HS1 includes a bezel 101, and the antennas A1 to A8 and the blocking members B1 to B3 in FIG. 1 can be disposed within the bezel 101. The electronic device 2 further includes a display 102, which is disposed in the first housing HS1 and is encircled by the bezel 101. In other words, the antennas A1 to A8 and the blocking members B1 to B3 can be disposed around the display 102, so as to minimize influences of peripheral metal elements upon the antennas A1 to A8 and to ensure that the performance of the antennas and the operation performance of the electronic device 2 meet application requirements (for example, enabling the electronic device 2 to meet over-the-air (OTA) test requirements).

The antenna module 10 further includes a ninth antenna A9, which is disposed near the sixth edge E6 of the second housing HS2 and operates at the third frequency band. The third antenna A3 has a field pattern orientation D3 toward a first direction (for example, a direction opposite to the direction Z), the seventh antenna A7 has a field pattern orientation D7 (for example, the direction Z) toward a second direction, and the ninth antenna A9 has a field pattern orientation D9 (for example, the direction Y) toward a third direction. The field pattern orientation D3 of the third antenna A3 is opposite to the field pattern orientation D7 of the seventh antenna A7, and the field pattern orientation D9 of the ninth antenna A9 is individually perpendicular to the field pattern orientation D3 of the third antenna A3 and the field pattern orientation D7 of the seventh antenna A7. Preferably, each of the third antenna A3, the seventh antenna A7 and the ninth antenna A9 is a 4×1 patch antenna array and is a millimeter wave (mmWAVE) antenna, and waveform radiation ranges of antenna field patterns of the third antenna A3, the seventh antenna A7 and the ninth antenna A9 are individually 120 degrees. Accordingly, the present invention configures the field pattern orientations D3 and D7 of the antennas A3 and A7 to be in opposite directions, and configures the field pattern orientation D9 of the antenna A9 to be individually perpendicular to the field pattern orientations D3 and D7 of the antennas A3 and A7, allowing the radiation field patterns of the three antennas A3, A7 and A9 to achieve greater ranges. Moreover, the field pattern orientation D3 of the antenna A3 is configured to be a direction opposite to the third direction Z, and the field pattern orientation D9 of the antenna A9 is configured to be the direction Y. Thus, during use of the electronic device 2, since the open angle of the first housing HS1 and the second housing HS2 is habitually more than 90 degrees, the field pattern orientation D3 of the antenna A3 and the field pattern orientation D9 of the antenna A9 can cover a maximum range, thereby optimizing the overall wireless communication performance of the electronic device 2 by means of the above configuration.

In one embodiment, the field pattern orientations D3, D7 and D9 of the three antennas A3, A7 and A9 can be configured to be perpendicular to one another. For example, the field pattern orientation D7 of the antenna A7 is configured to be the direction X, or the field pattern orientation D3 of the antenna A3 is configured to be a direction opposite to the direction X. Accordingly, the present invention configures the field pattern orientations D3, D7 and D9 of the three antennas A3, A7 and A9 to be perpendicular to one another, allowing the radiation field patterns of the three antennas A3, A7 and A9 to be complementary and hence equivalent to a 360-degree omnidirectional antenna, so as to optimize the overall wireless communication performance of the electronic device 2.

In one embodiment, the first direction is a direction from the second housing HS2 to the first housing HS1 when the first housing HS1 and the second housing HS2 are closed, the second direction is a direction from the first housing HS1 to the second housing HS2 when the first housing HS1 and the second housing HS2 are closed, and the third direction is a direction perpendicular to the plane (for example, the X-Y plane) where the second housing HS2 is located when the first housing HS1 and the second housing HS2 are open.

In one embodiment, the electronic device 2 further includes a keyboard 202 and a mouse touchpad 203, which are disposed in the second housing HS2. The ninth antenna A9 can be disposed between the sixth edge E6 and the keyboard 202 and near the junction between the sixth edge E6 and the fifth edge E5. Under such element configuration, when a user operates the electronic device 2, the ninth antenna A9 is kept away from human tissues (for example, the torso) as much as possible, so as to meet safety specifications of wireless communication products.

In brief, the present invention configures the positions of the antennas A1 to A8 in the antenna module 10 or in the first housing HS1 and the position of the antenna A9 in the second housing HS2 according to the antenna characteristics (for example, operating frequency band range, radiation field pattern and polarization direction) of the plurality of antennas A1 to A9, so as to optimize the overall wireless communication performance of the electronic device 2 to meet application requirements, and to allow the electronic device 2 to meet safety specifications of wireless communication products.

Second Embodiment

Figure 3:
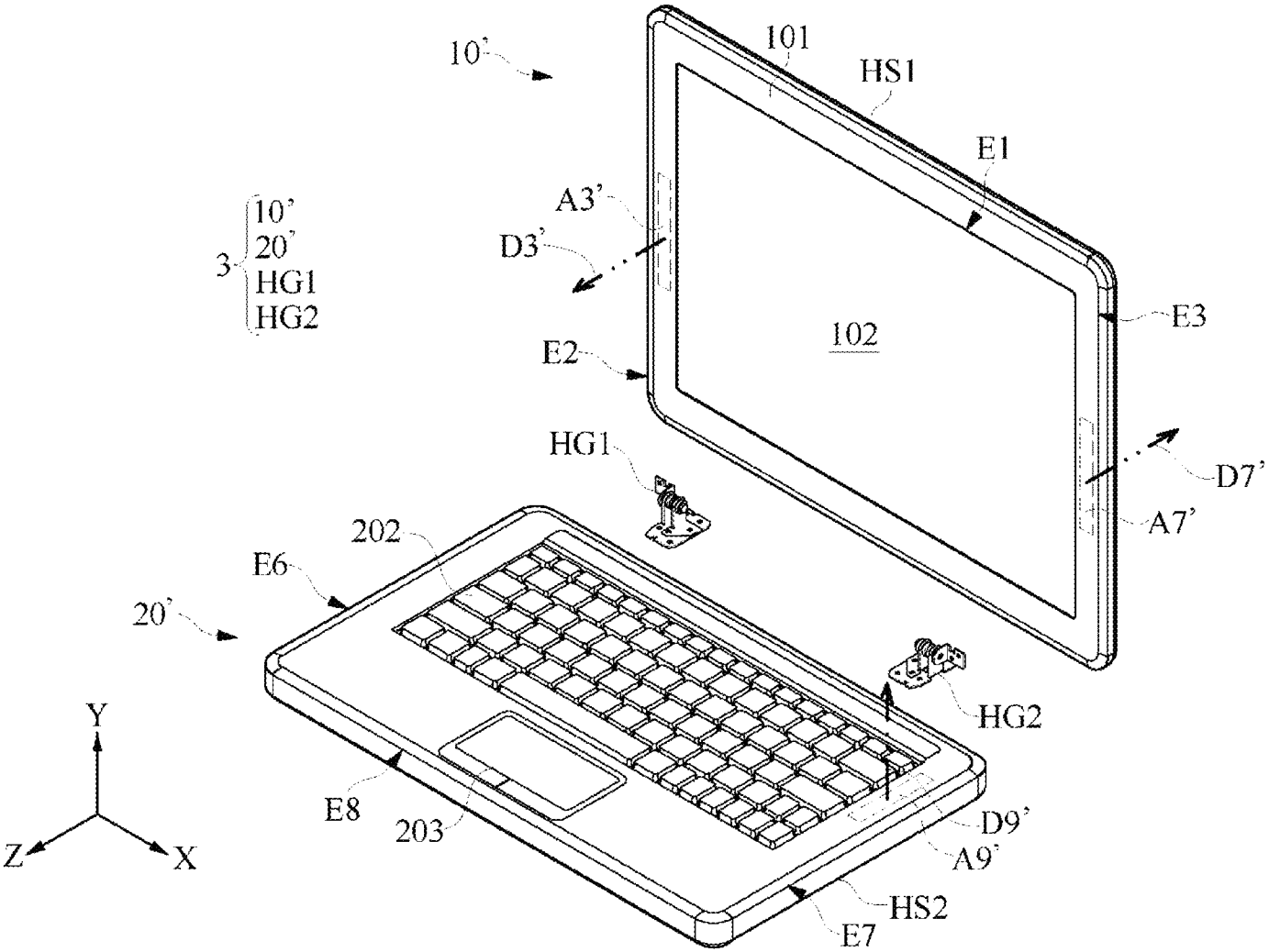
FIG. 3 is an exploded three-dimensional schematic diagram of an electronic device according to a second embodiment of the present invention.

FIG. 3 shows an exploded three-dimensional schematic diagram of an electronic device 3 according to a second embodiment of the present invention. The electronic devices 2 and 3 differ in that, a ninth antenna A9' is disposed between the seventh edge E7 of the second housing HS2 of a system module 20' and the keyboard 202 and near the junction between the seventh edge E7 and the fifth edge E5, the field pattern orientation D3 of the third antenna A3 in FIG. 2 is opposite to a field pattern orientation D3' of a third antenna A3' in FIG. 3, and the field pattern orientation D7 of the seventh antenna A7 in FIG. 2 is opposite to a field pattern orientation D7' of a seventh antenna A7' in FIG. 3, wherein the third antenna A3' and the seventh antenna A7' are disposed in a first antenna module 10'. The field pattern orientation D9 of the ninth antenna A9 in FIG. 2 is same as a field pattern orientation D9' of the ninth antenna A9' in FIG. 3. Preferably, each of the antennas A3', A7' and A9' is a 4×1 patch antenna array, and the beam radiation ranges of the antenna field pattern of the antenna A3', A7' and A9' are individually 120 degrees. Accordingly, the present invention configures the field pattern orientations D3' and D7' of the antennas A3' and A7' to be in opposite directions, and configures the field pattern orientation D9' of the antenna A9' to be individually perpendicular to the field pattern orientations D3' and D7' of the antennas A3' and A7', allowing the radiation field patterns of the three antennas A3', A7' and A9' to achieve greater ranges. In one embodiment, the field pattern orientations D3', D7' and D9' of the three antennas A3', A7 and A9' can also be configured to be perpendicular to one another. For example, the field pattern orientation D7' of the antenna A7' is configured to be the direction X, or the field pattern orientation D3' of the antenna A3' is configured to a direction opposite to the direction X. Accordingly, the present invention configures the field pattern orientations D3', D7' and D9' of the three antennas A3', A7' and A9' to be perpendicular to one another, allowing the radiation field patterns of the three antennas A3', A7' and A9' to be complementary and hence equivalent to a 360-degree omnidirectional antenna, so as to optimize the overall wireless communication performance of the electronic device 3.

Figure 4:
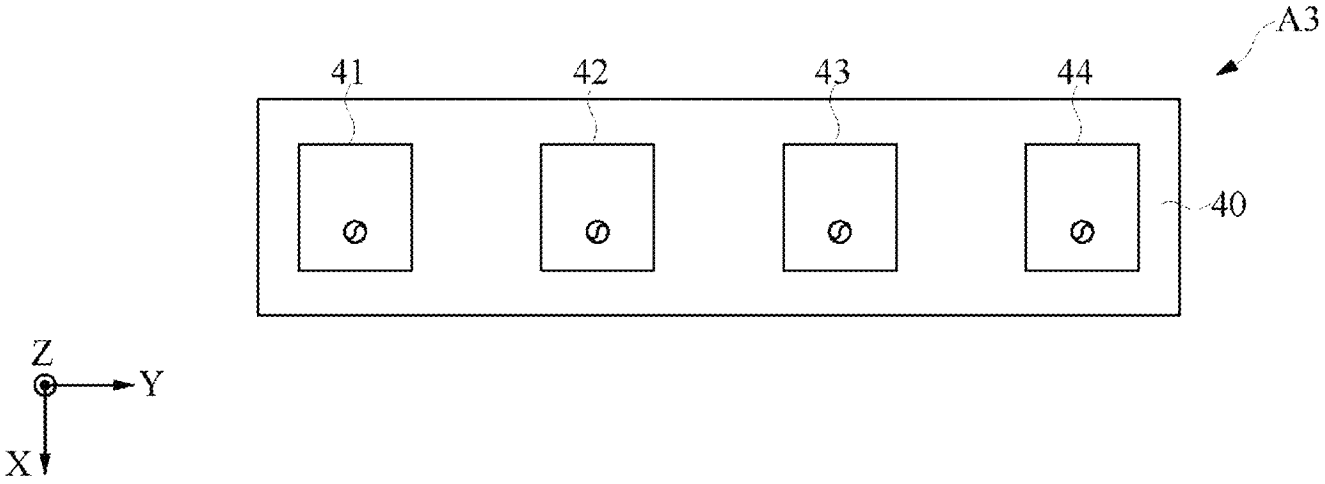
FIG. 4 is a front schematic diagram of a third antenna according to the first and second embodiments of the present invention.
Figure 5:
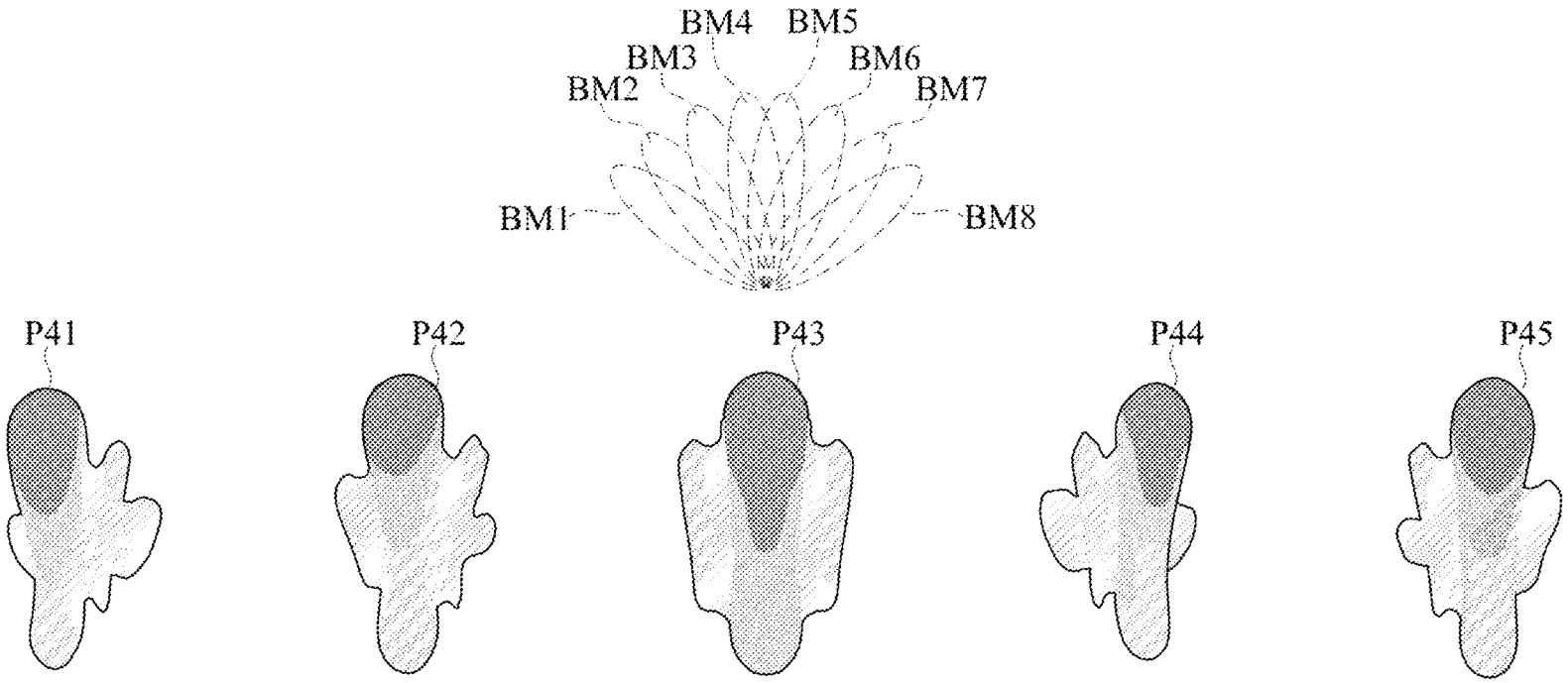
FIG. 5 is a schematic diagram of a radiation field pattern of a third antenna according to the first and second embodiments of the present invention.

FIG. 4 shows a front schematic diagram of the third antenna A3 according to the first embodiment and the second embodiment of the present invention. FIG. 5 shows a schematic diagram of a radiation field pattern of the third antenna A3 according to the first embodiment and the second embodiment of the present invention. The third antenna A3, the seventh antenna A7 and the ninth antenna A9 have the same structure, and are all 4×1 patch antenna arrays. Take the third antenna A3 as an example for illustrations. The third antenna A3 includes four patch antennas 41, 42, 43 and 44 and a substrate 40. Structurally, as shown in FIG. 4, patch antennas 41, 42, 43 and 44 are sequentially disposed in a second direction on the substrate 40. In operation, as shown in FIG. 5, by adjusting and shifting the phases of radio frequency signals fed into the patch antennas 41, 42, 43 and 44, multiple different radiation field patterns P41 to P45 and multiple beams BM1 to BM8 can be formed.

Benefits of the Embodiments

One benefit of the present invention is that, the antenna module and the electronic device provided by the present invention are, by the technical solution of "configuring the positions of the plurality of antennas in the antenna module or in the first housing and configuring the position of the other antenna in the second housing according to antenna characteristics (for example, operating frequency range, radiation field pattern and polarization direction) of the plurality of antennas, capable of optimizing the overall wireless communication performance of the electronic device to meet application requirements and allowing the electronic device to meet safety specifications of wireless communication products.

One benefit of the present invention is that, the antenna module and the electronic device provided by the present invention are, by the technical solution of "configuring the field pattern orientations of three antennas to be non-overlapping, and enabling the radiation field patterns of the three antennas to be complementary and hence equivalent to a 360-degree omnidirectional antenna", capable of optimizing the overall wireless communication performance of the electronic device to meet application requirements.

The contents disclosed above are merely preferred feasible embodiments of the present invention and are not to be construed as limitations to the claims of the present invention. Therefore, any equivalent technical changes made on the basis of the detailed description and drawings of the present invention are to be encompassed within the scope of the appended claims.

What is claimed is:

1. An electronic device, being characterized in that the electronic device comprises:

a first housing, comprising a first edge, a second edge, a third edge and a fourth edge, wherein the first edge is parallel to the fourth edge, and the second edge is parallel to the third edge; and an antenna module, comprising:

a first antenna, disposed in the first housing, operating only at a first frequency band;

a second antenna, disposed in the first housing, operating only at a second frequency band;

a third antenna, disposed in the first housing and located between the first antenna and the second antenna, operating only at a third frequency band;

a fourth antenna, disposed in the first housing and located between the first antenna and the third antenna, operating only at the first frequency band; and a fifth antenna, disposed in the first housing, operating only at the first frequency band;

wherein, the first frequency band partially overlaps with the second frequency band, and the third frequency band does not overlap with the first frequency band and the second frequency band; and wherein, the first antenna and the fifth antenna are disposed to be adjacent to the first edge, the first antenna is located closer to the second edge than the third edge, the fifth antenna is located closer to the third edge than the second edge, and the first antenna and the fifth antenna are arranged to be symmetrical with each other with respect to a center line of the first housing.

2. The electronic device according to claim 1, being characterized in that, the second antenna and the third antenna are disposed to be adjacent to the second edge.

3. The electronic device according to claim 1, being characterized in that, the fourth antenna is disposed to be adjacent to the second edge.

4. The electronic device according to claim 3, being characterized in that, the antenna module further comprises:

a first blocking member, disposed between the first antenna and the fourth antenna, and disposed at a junction between the first edge and the second edge.

5. The electronic device according to claim 3, being characterized in that, the antenna module further comprises:

a sixth antenna, disposed to be adjacent to the third edge, operating only at the second frequency band;

a seventh antenna, disposed to be adjacent to the third edge and located between the fifth antenna and the sixth antenna, operating only at the third frequency band; and an eighth antenna, disposed to be adjacent to the third edge, operating only at the first frequency band, and disposed between the fifth antenna and the seventh antenna;

wherein, the second antenna and the sixth antenna are arranged to be symmetrical with each other with respect to the center line of the first housing, the third antenna and the seventh antenna are arranged to be symmetrical with each other with respect to the center line of the first housing, and the fourth antenna and the eighth antenna are arranged to be symmetrical with each other with respect to the center line of the first housing, respectively.

6. The electronic device according to claim 5, being characterized in that, field pattern orientations of the third antenna and the seventh antenna are opposite.

7. The electronic device according to claim 5, being characterized in that, the electronic device further comprises:

a second housing, comprising a fifth edge, a sixth edge, a seventh edge and an eighth edge, wherein the fifth edge is parallel to the eighth edge, the sixth edge is parallel to the seventh edge, the fifth edge of the second housing is pivotally connected to the fourth edge of the first housing, the sixth edge and the seventh edge correspond to the second edge and the third edge of the first housing, respectively;

wherein, the antenna module further comprises:

a ninth antenna, disposed to be adjacent to the sixth edge or the seventh edge of the second housing, and operating only at the third frequency band.

8. The electronic device according to claim 7, being characterized in that, each of the third antenna, the seventh antenna and the ninth antenna is a 4×1 patch antenna array, and structures of the third antenna, the seventh antenna and the ninth antenna are identical.

9. The electronic device according to claim 7, being characterized in that, the electronic device further comprises:

a third blocking member, disposed to be adjacent to the first edge, and disposed between the first antenna and the fifth antenna.

10. The electronic device according to claim 7, being characterized in that, the third antenna has a field pattern orientation toward a first direction, the seventh antenna has a field pattern orientation toward a second direction, the first direction is a direction from the second housing to the first housing when the first housing and the second housing are closed, and the second direction is a direction from the first housing to the second housing when the first housing and the second housing are closed; wherein, the ninth antenna is disposed on the sixth edge of the second housing.

11. The electronic device according to claim 5, being characterized in that, the electronic device further comprises:

a first blocking member, disposed between the first antenna and the fourth antenna, and disposed at a junction between the first edge and the second edge; and a second blocking member, disposed between the fifth antenna and the eighth antenna, and disposed at a junction between the first edge and the third edge;

wherein the first blocking member and the second blocking member are arranged to be symmetrical with each other with respect to the center line of the first housing.

12. An electronic device, being characterized in that the electronic device comprises:

a first housing, comprising a first edge, a second edge, a third edge and a fourth edge, wherein the first edge is parallel to the fourth edge, and the second edge is parallel to the third edge;

a second housing, comprising a fifth edge, a sixth edge, a seventh edge and an eighth edge, wherein the fifth edge is parallel to the eighth edge, the sixth edge is parallel to the seventh edge, the fifth edge of the second housing is pivotally connected to the fourth edge of the first housing, the sixth edge and the seventh edge correspond to the second edge and the third edge of the first housing, respectively; and an antenna module, comprising:

a first antenna, disposed in the first housing to be adjacent to the first edge, operating only at a first frequency band;

a second antenna, disposed in the first housing to be adjacent to the second edge, operating only at a second frequency band;

a third antenna, disposed in the first housing to be adjacent to the second edge and located between the first antenna and the second antenna, operating only at a third frequency band;

a fourth antenna, disposed in the first housing to be adjacent to the second edge and located between the first antenna and the third antenna, operating only at the first frequency band; and a fifth antenna, disposed in the first housing to be adjacent to the first edge, operating only at the first frequency band;

a sixth antenna, disposed in the first housing to be adjacent to the third edge, operating only at the second frequency band;

a seventh antenna, disposed in the first housing to be adjacent to the third edge and located between the fifth antenna and the sixth antenna, operating at the third frequency band;

an eighth antenna, disposed in the first housing to be adjacent to the third edge and located between the fifth antenna and the seventh antenna, operating at the first frequency band; and a ninth antenna, disposed in the second housing to be adjacent to the sixth edge or the seventh edge, and operating only at the third frequency band;

wherein, the first frequency band partially overlaps with the second frequency band, and the third frequency band does not overlap with the first frequency band and the second frequency band; and wherein, each of the third antenna, the seventh antenna and the ninth antenna is a 4×1 patch antenna array, and structures of the third antenna, the seventh antenna and the ninth antenna are identical.

13. The electronic device according to claim 12, being characterized in that, field pattern orientations of the third antenna and the seventh antenna are opposite.

14. The electronic device according to claim 12, being characterized in that, the first antenna and the fifth antenna are arranged to be symmetrical with each other with respect to a center line of the first housing, the second antenna and the sixth antenna are arranged to be symmetrical with each other with respect to the center line of the first housing, the third antenna and the seventh antenna are arranged to be symmetrical with each other with respect to the center line of the first housing, and the fourth antenna and the eighth antenna are arranged to be symmetrical with each other with respect to the center line of the first housing, respectively.

15. The electronic device according to claim 12, being characterized in that, the electronic device further comprises:

a first blocking member, disposed between the first antenna and the fourth antenna, and disposed at a junction between the first edge and the second edge; and a second blocking member, disposed between the fifth antenna and the eighth antenna, and disposed at a junction between the first edge and the third edge;

wherein the first blocking member and the second blocking member are arranged to be symmetrical with each other with respect to a center line of the first housing.

16. The electronic device according to claim 15, being characterized in that, the electronic device further comprises:

a third blocking member, disposed to be adjacent to the first edge, and disposed between the first antenna and the fifth antenna.

17. The electronic device according to claim 12, being characterized in that, the third antenna has a field pattern orientation toward a first direction, the seventh antenna has a field pattern orientation toward a second direction, the first direction is a direction from the second housing to the first housing when the first housing and the second housing are closed, and the second direction is a direction from the first housing to the second housing when the first housing and the second housing are closed; wherein, the ninth antenna is disposed on the sixth edge of the second housing.

* * * * *